US008730287B2

(12) United States Patent
Bouverie et al.

(10) Patent No.: US 8,730,287 B2
(45) Date of Patent: May 20, 2014

(54) RIBBON DRIVE ASSEMBLY

(75) Inventors: William M. Bouverie, Windermere, FL (US); Mark Allen Hitz, Rock Hill, SC (US); Marjorie Hitz, legal representative, Rock Hill, SC (US); Roger Keith Owens, Indian Trail, NC (US)

(73) Assignee: Datamax-O'Neil Corporation, Orlando, FL (US)

( * ) Notice: Subject to any disclaimer, the term of this patent is extended or adjusted under 35 U.S.C. 154(b) by 0 days.

(21) Appl. No.: 13/530,747

(22) Filed: Jun. 22, 2012

(65) Prior Publication Data

US 2012/0327166 A1 Dec. 27, 2012

Related U.S. Application Data

(60) Provisional application No. 61/500,773, filed on Jun. 24, 2011.

(51) Int. Cl.
*B41J 17/00* (2006.01)

(52) U.S. Cl.
USPC ..... 347/217

(58) Field of Classification Search
USPC ..... 347/217
See application file for complete search history.

(56) References Cited

U.S. PATENT DOCUMENTS

| | | | |
|---|---|---|---|
| 4,143,977 | A | 3/1979 | Kurihara et al. |
| 4,177,731 | A | 12/1979 | Kleist et al. |
| 4,788,558 | A | 11/1988 | Caldwell et al. |
| 4,788,559 | A | 11/1988 | Ende |
| 4,872,659 | A | 10/1989 | Kato et al. |
| 4,924,240 | A | 5/1990 | Herbert et al. |
| 4,991,846 | A | 2/1991 | Sondej |
| 5,028,155 | A | 7/1991 | Sugiura et al. |
| 5,087,137 | A | 2/1992 | Burnard et al. |
| 5,206,662 | A | 4/1993 | Fox et al. |
| 5,326,182 | A | 7/1994 | Hagstrom |
| 5,397,192 | A | 3/1995 | Khormaee |
| 5,468,076 | A | 11/1995 | Hirano et al. |

(Continued)

FOREIGN PATENT DOCUMENTS

JP 04552558 B2 9/2010

OTHER PUBLICATIONS

Written Opinion of the International Searching Authority, PCT/US2012/036297, Jul. 17, 2012.

(Continued)

*Primary Examiner* — Huan Tran
(74) *Attorney, Agent, or Firm* — Carter DeLuca Farrell & Schmidt LLP

(57) ABSTRACT

A ribbon drive assembly for optimizing the tension across a ribbon supply in a thermal transfer printer comprising a supply spindle and a take up spindle operable for cooperating with each other such that the ribbon supply is fed from the supply spindle through a print station and metered onto the take up spindle. Each spindle is provided with and connected to a motor, a plurality of gears, and a rotary encoder such that the spindles may be independently controlled by a control processor. The control processor is operable for monitoring, detecting, and controlling the operation of the motors and spindles. During operation and in order to maintain a constant ribbon tension, the torque on the motors are continuously adjusted in accordance with various data provided by the printer's processor.

20 Claims, 7 Drawing Sheets

(56) References Cited

U.S. PATENT DOCUMENTS

| | | | | |
|---|---|---|---|---|
| 5,490,638 | A | 2/1996 | Driftmyer et al. | |
| 5,564,841 | A | 10/1996 | Austin et al. | |
| 5,600,350 | A | 2/1997 | Cobbs et al. | |
| 5,650,730 | A | 7/1997 | Herbst, Jr. | |
| 5,684,516 | A | 11/1997 | Cseledy et al. | |
| 5,790,162 | A | 8/1998 | Adams et al. | |
| 5,820,280 | A | 10/1998 | Fox | |
| 5,836,704 | A | 11/1998 | Lau et al. | |
| 5,870,114 | A | 2/1999 | Numata et al. | |
| 5,872,585 | A | 2/1999 | Donato et al. | |
| 5,874,980 | A | 2/1999 | West | |
| 5,909,233 | A | 6/1999 | Hamman et al. | |
| 5,927,875 | A | 7/1999 | Lau et al. | |
| 5,978,004 | A | 11/1999 | Ehrhardt | |
| 5,995,128 | A | 11/1999 | Adams et al. | |
| 6,014,229 | A | 1/2000 | Yun | |
| 6,020,906 | A | 2/2000 | Adams et al. | |
| 6,034,708 | A | 3/2000 | Adams et al. | |
| 6,057,870 | A | 5/2000 | Monnier et al. | |
| 6,070,048 | A | 5/2000 | Nonaka et al. | |
| 6,082,914 | A | 7/2000 | Barrus et al. | |
| 6,095,704 | A | 8/2000 | Jaeger et al. | |
| 6,099,178 | A | 8/2000 | Spurr et al. | |
| 6,129,463 | A | 10/2000 | Lau et al. | |
| 6,201,255 | B1 | 3/2001 | Torchalski et al. | |
| 6,283,024 | B1 | 9/2001 | George | |
| 6,289,730 | B1 | 9/2001 | Elgee | |
| 6,302,604 | B1 | 10/2001 | Bryant et al. | |
| 6,389,241 | B1 | 5/2002 | Cernusak et al. | |
| 6,396,070 | B1 | 5/2002 | Christensen et al. | |
| 6,520,614 | B2 | 2/2003 | Kaneko | |
| 6,616,362 | B2 | 9/2003 | Bouverie et al. | |
| 6,825,864 | B2 | 11/2004 | Botten et al. | |
| 6,840,689 | B2 | 1/2005 | Barrus et al. | |
| 6,846,121 | B2 | 1/2005 | Bouverie et al. | |
| 6,857,714 | B2 | 2/2005 | Hohberger et al. | |
| 6,900,449 | B2 | 5/2005 | Bolash et al. | |
| 6,942,403 | B2 | 9/2005 | Hohberger et al. | |
| 7,042,478 | B2 | 5/2006 | Bouverie et al. | |
| 7,071,961 | B2 * | 7/2006 | Ullenius et al. | 347/219 |
| 7,079,168 | B2 * | 7/2006 | Ullenius et al. | 347/219 |
| 7,150,572 | B2 | 12/2006 | McNestry et al. | |
| 7,162,460 | B2 | 1/2007 | Cleckler et al. | |
| 7,205,561 | B2 | 4/2007 | Chelvayohan et al. | |
| 7,255,343 | B2 | 8/2007 | So | |
| 7,375,832 | B2 | 5/2008 | Bouverie et al. | |
| 7,456,995 | B2 | 11/2008 | Stephens | |
| 7,502,042 | B2 | 3/2009 | Hitz et al. | |
| 7,537,404 | B2 * | 5/2009 | Bouverie et al. | 400/693 |
| 7,600,684 | B2 | 10/2009 | Tobin et al. | |
| 7,667,874 | B2 | 2/2010 | MacDonald et al. | |
| 7,699,550 | B2 * | 4/2010 | Bouverie et al. | 400/234 |
| 7,824,116 | B2 | 11/2010 | Lyman | |
| 7,845,632 | B2 | 12/2010 | Windsor et al. | |
| 7,857,414 | B2 | 12/2010 | Eun et al. | |
| 7,876,223 | B2 | 1/2011 | Yamaguchi et al. | |
| 7,891,892 | B2 | 2/2011 | Chiu | |
| 7,907,159 | B2 | 3/2011 | Matsuo et al. | |
| 7,934,881 | B2 | 5/2011 | Lodwig et al. | |
| 7,938,501 | B2 | 5/2011 | Takamiya et al. | |
| 8,142,087 | B2 | 3/2012 | Kugimachi | |
| 2001/0008612 | A1 | 7/2001 | Liljestrand et al. | |
| 2003/0081024 | A1 | 5/2003 | Vives et al. | |
| 2003/0141655 | A1 | 7/2003 | Bryer | |
| 2004/0008365 | A1 | 1/2004 | Hobbs | |
| 2004/0114024 | A1 * | 6/2004 | Bouverie et al. | 347/219 |
| 2004/0165927 | A1 | 8/2004 | Fisher et al. | |
| 2005/0002715 | A1 | 1/2005 | Fries et al. | |
| 2005/0189693 | A1 | 9/2005 | Ko | |
| 2005/0190368 | A1 | 9/2005 | Ehrhardt et al. | |
| 2005/0204940 | A1 | 9/2005 | Elliott et al. | |
| 2006/0007295 | A1 | 1/2006 | Ueda | |
| 2006/0045601 | A1 | 3/2006 | Endo | |
| 2006/0055721 | A1 | 3/2006 | Burdette et al. | |
| 2006/0157911 | A1 | 7/2006 | Learmonth et al. | |
| 2006/0159504 | A1 | 7/2006 | Blanchard et al. | |
| 2006/0180737 | A1 | 8/2006 | Consiglio | |
| 2007/0022233 | A1 | 1/2007 | Bridges et al. | |
| 2007/0040326 | A1 | 2/2007 | Noda et al. | |
| 2007/0059078 | A1 | 3/2007 | Silverbrook et al. | |
| 2007/0138738 | A1 | 6/2007 | Motohashi et al. | |
| 2009/0038495 | A1 | 2/2009 | Butzen et al. | |
| 2009/0103806 | A1 | 4/2009 | Nakami | |
| 2009/0244584 | A1 | 10/2009 | Mcgarry et al. | |
| 2010/0066782 | A1 | 3/2010 | Yamamoto et al. | |
| 2010/0169513 | A1 | 7/2010 | Levin | |
| 2010/0247222 | A1 | 9/2010 | Bouverie et al. | |
| 2010/0319561 | A1 | 12/2010 | Colquitt et al. | |
| 2011/0042883 | A1 | 2/2011 | Wang et al. | |
| 2011/0132643 | A1 | 6/2011 | Hattori et al. | |

OTHER PUBLICATIONS

Written Opinion of the International Searching Authority, PCT/US2012/039043, Aug. 3, 2012.
Written Opinion of the International Searching Authority, PCT/US2012/041093, Aug. 7, 2012.
Written Opinion of the International Searching Authority, PCT/US2012/043734, Sep. 21, 2012.
Written Opinion of the International Searching Authority, PCT/US2012/043709, Sep. 21, 2012.
Written Opinion of the International Searching Authority, PCT/US2012/043772, Sep. 14, 2012.
Written Opinion of the International Searching Authority, PCT/US2012/046712, Oct. 5, 2012.
Written Opinion of the International Searching Authority, PCT/US2012/049417, Nov. 2, 2012.
Written Opinion of the International Searching Authority, PCT/US2012/050938, Nov. 6, 2012.
Written Opinion of the International Searching Authority, PCT/US2012/060956, Jan. 11, 2013.
Written Opinion of the International Searching Authority, PCT/US2012/066291, Feb. 5, 2013.

* cited by examiner

RIBBON DRIVE ASSEMBLY

CROSS-REFERENCE TO RELATED APPLICATION(S)

This application claims priority to provisional patent application No. 61/500,773, filed Jun. 24, 2011, and entitled "Ribbon Drive Assembly", the contents of which are incorporated in full by reference herein.

FIELD OF INVENTION

The present invention generally relates to ribbon drive assemblies utilized in printers, more specifically, a ribbon drive assembly that continuously adjusts supply and take up spindle torque to optimize ribbon tension and take up.

BACKGROUND

Printing systems such as copiers, printers, facsimile devices or other systems having a print engine for creating visual images, graphics, texts, etc. on a page or other printable medium typically include various media feeding systems for introducing original image media or printable media into the system. Examples include thermal transfer printers. Typically, a thermal transfer printer is a printer which prints on media by melting a coating of ribbon so that it stays glued to the media on which the print is applied. It contrasts with direct thermal printing where no ribbon is present in the process. Typically, thermal transfer printers comprise a supply spindle operable for supplying a media web and ribbon, a print station, and a take up spindle. New ribbon and media is fed from the supply spindle to the print station for printing and then the ribbon is wound up by the take up spindle while the media is exited from the print station. As the ribbon exits the print station it is rewound on the take up spindle. Over the course of operation, the new ribbon on the supply spindle gradually decreases in radius while the used ribbon on the take up spindle gradually increases in radius.

Thermal transfer ribbons are supplied either coated side in or coated side out. In locations where these printers are used, it is common to have both types of ribbons. Ribbons wound coated side in rotate counter-clockwise during movement in the process direction, whereas ribbons wound coated side out rotate clockwise during movement in the process direction. Further, the ribbons come in various widths and in various ink compositions such has wax, wax/resin, or resin. For optimal print quality and reliable operation, it is desirable to be able to maintain a constant tension on the segment of ribbon being fed from the supply spindle to the print station and the segment from the print station to the take up spindle. It is also desirable to match the tension level with the ribbon width and composition.

A person of ordinary skill in the art will appreciate that the tension on the segment of ribbon between the supply spindle and the print station is generated by the print station pulling the ribbon and the supply spindle resisting this movement by applying force in the opposite direction. Conversely, the tension on the segment of the ribbon between the print station and the take up spindle is generated by the print station metering the ribbon at a fixed rate while the take up spindle is pulling the ribbon at an increased forced level in the same direction.

Referring now to FIG. 1, an exemplary conventional system 10 used in thermal transfer printers is shown. As shown, a supply spindle 12 is provided and feeds or supplies new/unused ribbon 14 with a coated side in configuration. The unused ribbon 14 is fed or supplied through a print station 16 where ink is deposited upon a media (not shown) which passes through a media feed path. Upon printing, used ribbon 18 is fed to a take up spindle 20 and wound about the same. Tensile forces (F) are placed upon both the unused ribbon 14 and the used ribbon 18. The tension or force on the ribbon is defined by the following equation:

$$F=T/r$$

where: F=torque/radius;
T=torque applied by the spindle; and
r=radius of the ribbon.

As shown in FIG. 1, if the spindle torque is constant, the force (F) on the ribbon is directly proportional to the ribbon radius on the spindle. For the supply spindle 12, as the new ribbon 14 is used and the radius decreases, the force (F) on the ribbon 14 will decrease. For the take up spindle 20, as the radius of the used ribbon 18 increases, the force (F) on the ribbon 18 increases.

Conventional thermal transfer printers have attempted to provide a constant tension on the ribbons by using mechanical systems of springs and clutches to exert a constant torque on each of the supply and take up spindles. However, during operation, the tension on the ribbons varies due to the fluctuation of radius of each spindle. Further, due to the mechanical nature of the conventional systems, coated side in and coated side out ribbons are not supportable absent reconfiguration of the system.

It would therefore be desirable to provide a system or device which continuously adjusts spindle torque to maintain a constant ribbon tension as the radius varies without the need for a mechanical system of springs and clutches. It would also be desirable to provide a device which independently controls the supply and take up ribbon segments tension. It would also be desirable to provide a system or device which allows for the automatic selection of ribbon tensions for optimal performance based upon ribbon width and type. It would also be desirable to provide a system or device which allows for the use of coated side in or coated side out ribbons without the necessity of system reconfiguration. Finally, it would be desirable to provide a system or device which monitors, detects, reports and controls the operation of both the supply and take up spindles during a printing operation, thereby providing for a constant ribbon tension in either a steady or dynamic state and during forward to backwards feed.

SUMMARY OF THE INVENTION

The present invention is designed to overcome the deficiencies and shortcomings of the systems and devices conventionally known and described above by providing a novel ribbon drive assembly. The present invention is designed to reduce the manufacturing costs and the complexity of assembly.

In all exemplary embodiments, the present invention is directed to a ribbon drive assembly comprising a supply spindle and a take up spindle operable for cooperating with each other such that a ribbon supply is fed from the supply spindle through a print station and metered onto the take up spindle. In exemplary embodiments, each spindle is provided with and connected to a motor, a plurality of gears with a 23:1 gear reduction, and a rotary encoder. Each of the motors are independently controlled by a control processor connected to a circuit board and communicatively linked with the printer's main processor. The control processor is operable for monitoring, detecting via an associated sensing device, and controlling the operation of the motors and spindles.

During operation and in order to maintain a constant ribbon tension, the torque on the motors are continuously adjusted in accordance with various data provided by the printer's processor, including but not limited to, current feed speed of media, target feed speed of media, move direction, supply and take up tensions settings. In exemplary embodiments herein, the supply spindle and take up spindle are independently controlled to provide a constant tension on the ribbon before and after the same passes through the print station. The ribbon tension is maintained throughout the system regardless of the variation of the ribbon roll diameter on the spindles. In exemplary embodiments, a dynamic setpoint proportional integral controller operable for controlling the steady state and dynamic state requirements of the ribbon system is included.

The present invention is also designed such that it continuously adjusts spindle torque to maintain a constant ribbon tension within the ribbon assembly as the ribbon radius changes. The present invention is advantageous as it provides for an independent control of supply and take up segments tension associated with the used and unused portions of the ribbon. The present invention is also advantageous as is allows for electronic selection of desired tension values either from printer front panel or data stream. The present invention is also advantageous as it allows for automatic selection of ribbon tensions for optimal performance based on ribbon width and type. The present invention is also advantageous as it allows for the use of coated side in or coated side out ribbon configurations by electronically selecting the ribbon type without requiring a mechanical reconfiguration. The present invention is also advantageous as it provides a ribbon drive assembly which precisely controls ribbon tension during forward and backwards feed. The present invention is also advantageous as it provides a ribbon drive assembly which precisely controls ribbon tension both in constant velocity (steady state) and acceleration (dynamic) portions of the movement and compensates for mechanical system instability. The present invention is also advantageous as it provides a ribbon drive assembly which is configured to pre-tension the ribbon supply after a print station has been opened and closed, detects and responds to load disturbances caused by media supply drag or print patterns, detects the radius of both spindles and reports the supply spindle radius to control circuitry of the printing device for the purposes of reporting a ribbon low warning.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description present exemplary embodiments of the invention, and are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the detailed description, serve to explain the principles and operations thereof.

BRIEF DESCRIPTION OF THE DRAWINGS

The present subject matter may take form in various components and arrangements of components, and in various steps and arrangements of steps. The appended drawings are only for purposes of illustrating exemplary embodiments and are not to be construed as limiting the subject matter.

DETAILED DESCRIPTION OF THE PREFERRED EMBODIMENT

The present invention will now be described more fully hereinafter with reference to the accompanying drawings in which exemplary embodiments of the invention are shown. However, this invention may be embodied in many different forms and should not be construed as limited to the embodiments set forth herein. These exemplary embodiments are provided so that this disclosure will be both thorough and complete, and will fully convey the scope of the invention to those skilled in the art. Further, as used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise.

Figure 1:
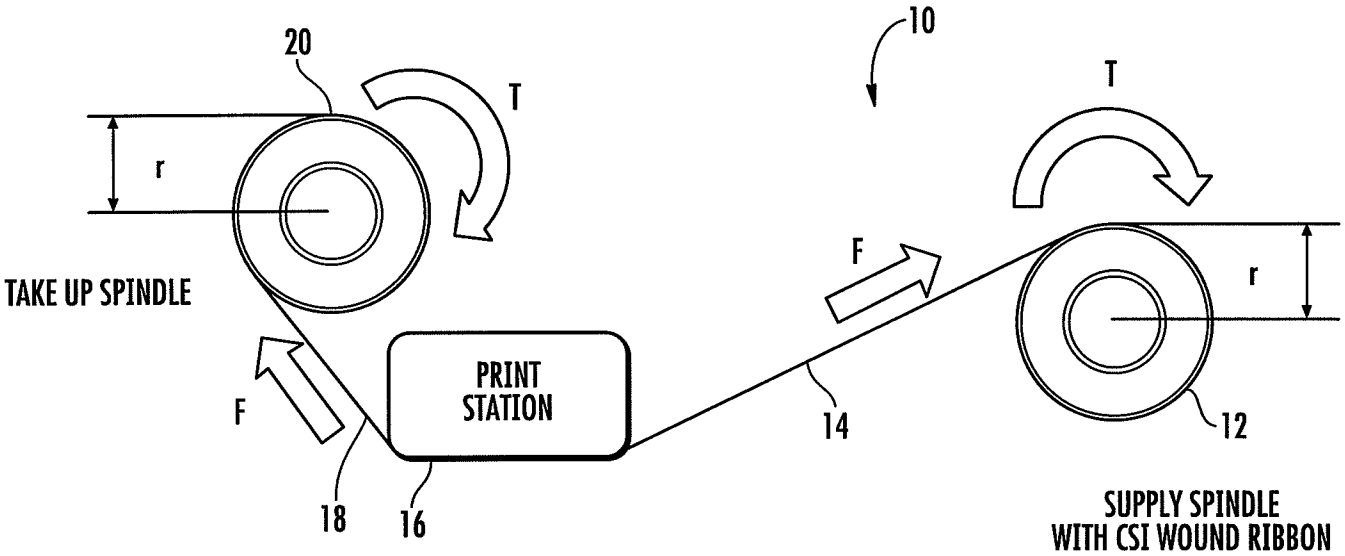
FIG. 1 is a schematic diagram of a conventional ribbon drive assembly.
Figure 2:
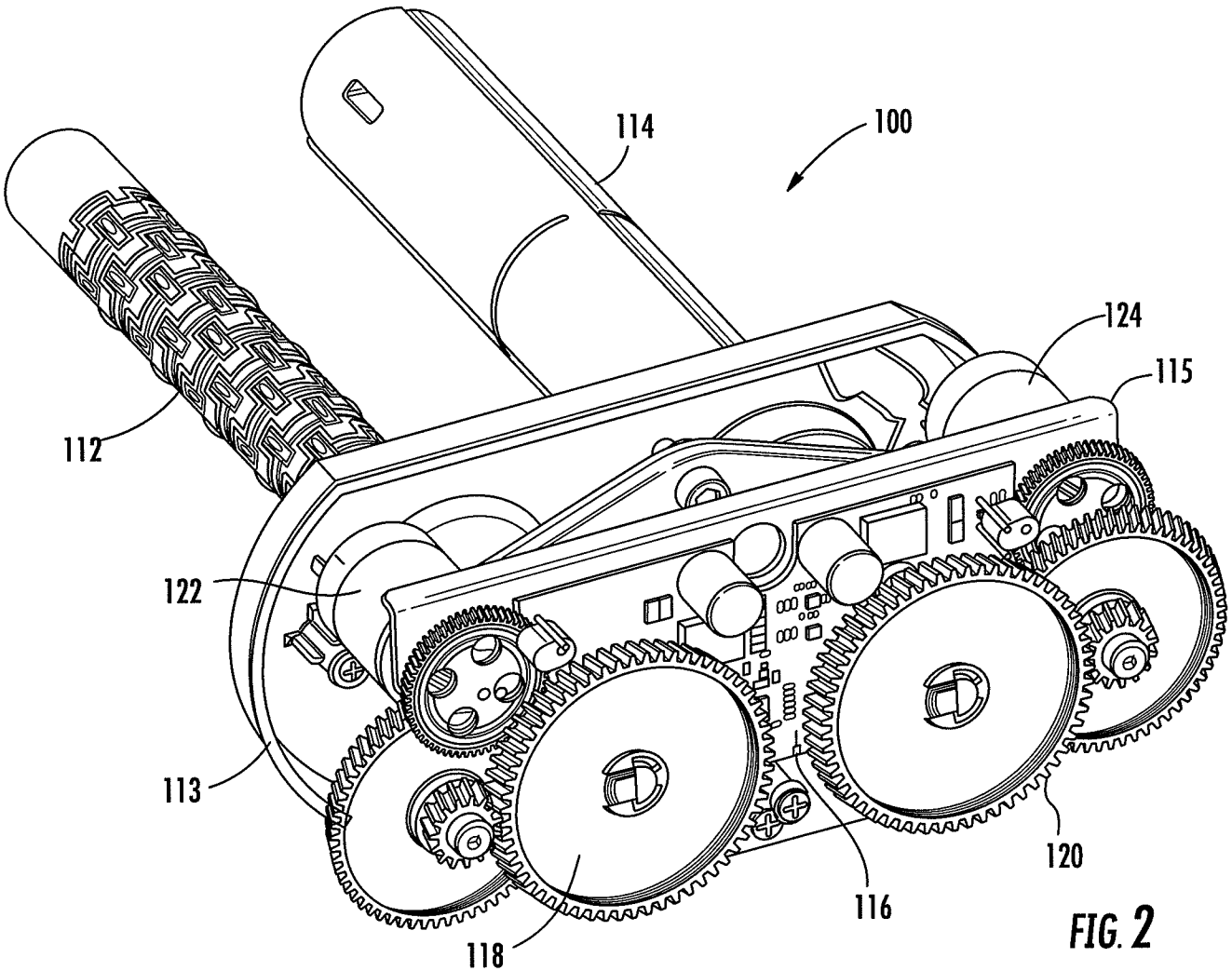
FIG. 2 is a perspective front view of the ribbon drive assembly of the present invention.
Figure 3:
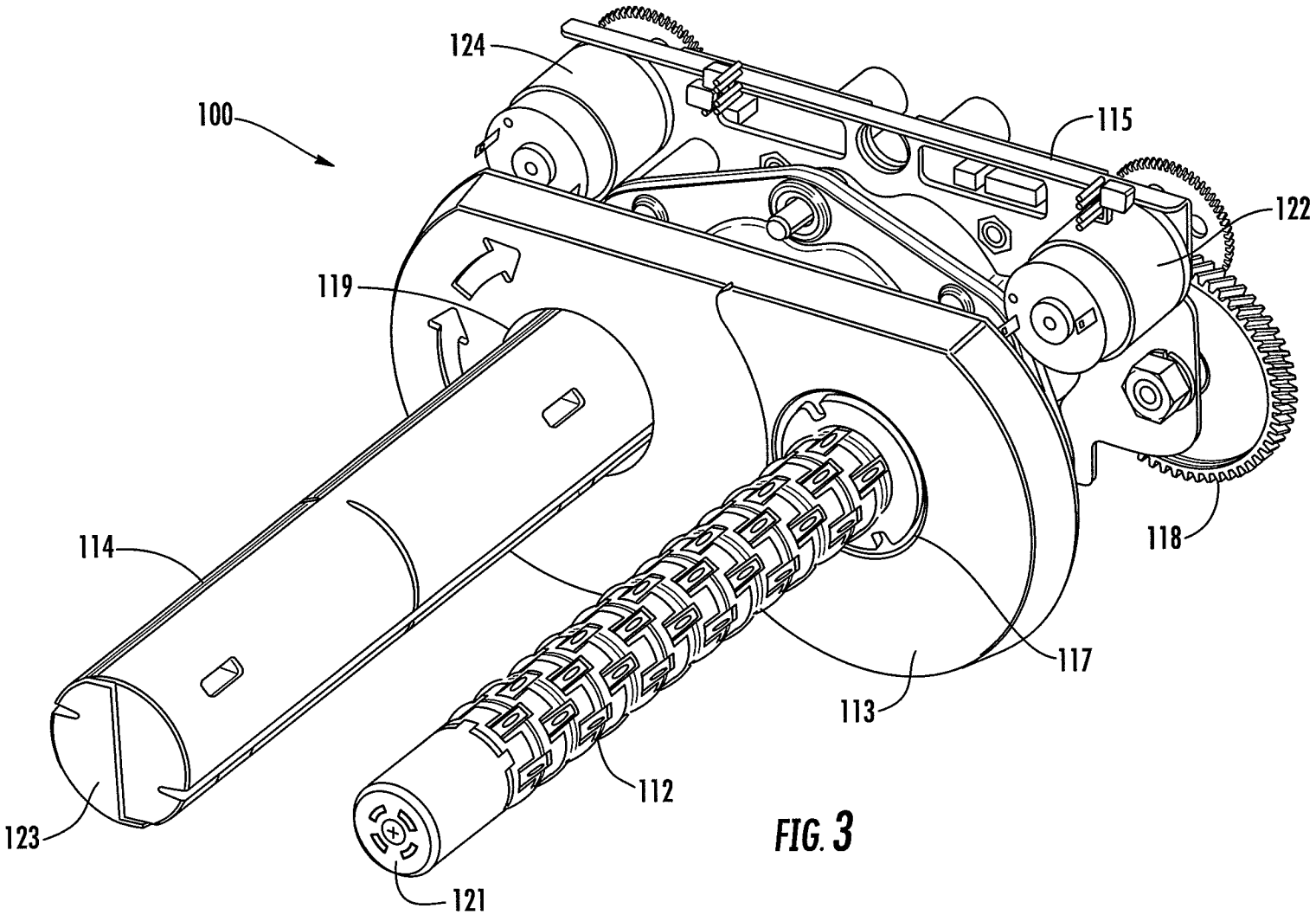
FIG. 3 is a perspective rear view of the embodiment of FIG. 2.
Figure 4:
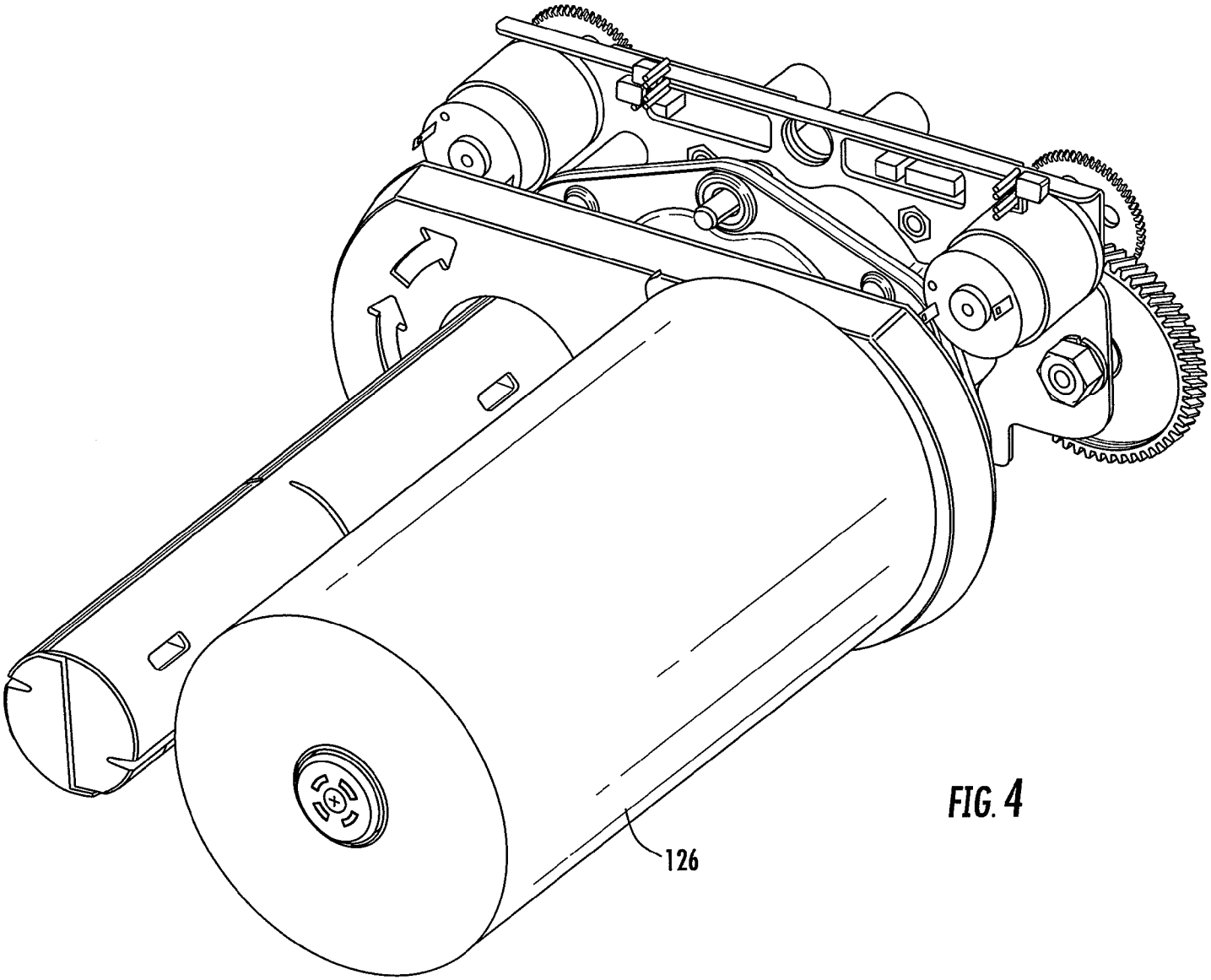
FIG. 4 is a perspective back view of the ribbon drive assembly of the present invention with a ribbon supply on the supply spindle.

Referring now to the drawings and specifically, FIGS. 2-3, a ribbon drive assembly in accordance with exemplary embodiments of the present invention is shown. In all exemplary embodiments, a ribbon drive assembly 100 is provided for maintaining a constant tension on a ribbon supply 126 as it peels off a supply spindle 112 into a print station (not shown) and is metered off onto a take up spindle 114.

In exemplary embodiments, the spindles 112, 114 are rotatably connected to a base plate 115 at one end and extend through a port 117, 119 of a cover plate 113 such that their respective distal ends 121, 123 are operative for receiving a roll of ribbon supply 126. Each spindle 112, 114 is provided with an independently operated drive system comprising a plurality of gears 118, 120 for rotating the spindles 112, 114, a motor 122, 124 for driving the plurality of gears 118, 120 in either a clockwise or counter clockwise direction, and a rotary encoder 150 (60 pulses/rev). In all exemplary embodiments, the drive system is connected to the base plate 115. In exemplary embodiments, the plurality of gears 118, 120 have a 23:1 gear reduction. It will be understood by those skilled in the art that it is contemplated that the motor 122, 124 will be a DC motor however, any type of motor suitable for powering the gears 118, 120 and spindles 112, 114 in a rotary movement may be employed. Further, in exemplary embodiments, the motors 122, 124 are independently operated to optimize ribbon tension.

The drive system further comprises a circuit board 116 connected to the base plate 115 having a control processor for each motor 122, 124 is provided and attached to a side of the base plate 115. The electronics of the circuit board 116 similarly have two sets of drive components for each spindle 112, 114. In exemplary embodiments, the drive system uses a Cypress PSoC3 which is a 8051 processor core with on chip programmable digital and analog functions and communication components. However, it will be understood by those skilled in the art that a variety of processors may be used. The processor, motor drive IC's, and opto encoders and associated circuitry are located on the single board 116 of the drive system. The bulk of the electrical components such as pulse width modulators, timers, ADC converter and other logic are programmed directly in to the PSoC part using its' system on a chip capabilities. The processor of the drive system is communicatively linked with a main processor of the printer (not shown) PCB via a SPI bus. Firmware updates to the drive system's processor may be made using a boot loader that communicates over an I2C bus.

To maintain constant ribbon tension throughout operation of the print station, the torque of the motors 122, 124 are continuously adjusted. The torque produced by a motor is directly proportion to the average motor current. Therefore the drive systems ultimately regulate motor current. The printer's main processor, via a defined message frame, informs the drive system of current feed speed, target feed speed, move direction, supply and take up tension settings. The drive system responds back to the main processor with current status, the supply ribbon radius, and the current firmware revision of the drive system. The drive system parses incoming message frames and then runs a motion control state of the printer. Based on feed direction, current speed, and target speed, the printer state transitions through various operating states such as idle, ramping up, constant velocity, ramping down, and back to idle. These states align to what the main processor is doing with a motor operable for controlling a platen roller.

The drive system calculates the supply spindle 112 radius and the take up spindle 114 radius by using the current speed information from the main processor and angular velocity information obtained from the rotary encoder. The radius information is then used to determine the required torque level of each motor 122, 124 to produce the tension level as requested by the main processor. The output of this torque calculation is the steady state motor current Setpoint (SP) which is maintained by a Proportional Integral (PI) control system. The negative feedback loop for this control system is motor current. Motor current is determined by reading the motor drive IC's sense resistor voltage using an ADC. This motor current is read at a very precise time towards the end of a PWM on cycle.

In exemplary embodiments, two independent control systems, one for each motor 122, 124, are executed every 500 us seconds. Each time the control systems run they adjust the Pulse Width Modulated (PWM) duty cycle which drives an H-Bridge motor IC's. The duty cycle of the PWM ultimately controls the average motor current, hence torque.

The aforementioned Setpoint calculations are valid for when the system is running at constant velocity i.e. steady state. This alone, however, is not sufficient for the dynamic behavior of the system such as when ramping up to print speed from a dead stop. To handle the dynamic behavior of the system a second negative feedback loop is employed. This feedback loop is the angular velocity of the motor measured by the encoder system. This feedback loop is not injected directly in to the current control loop but is used to shape the Setpoint input to the control system.

Ultimately the Setpoint input to the control system is comprised of two components, one based on steady state requirements and one based on dynamic behavior. By incorporating the outer velocity feedback loop the velocity and torque rise time and settling requirements of the system are met over a wide range of feed speeds, requested ribbon tensions, and ribbon radius.

Figure 5:
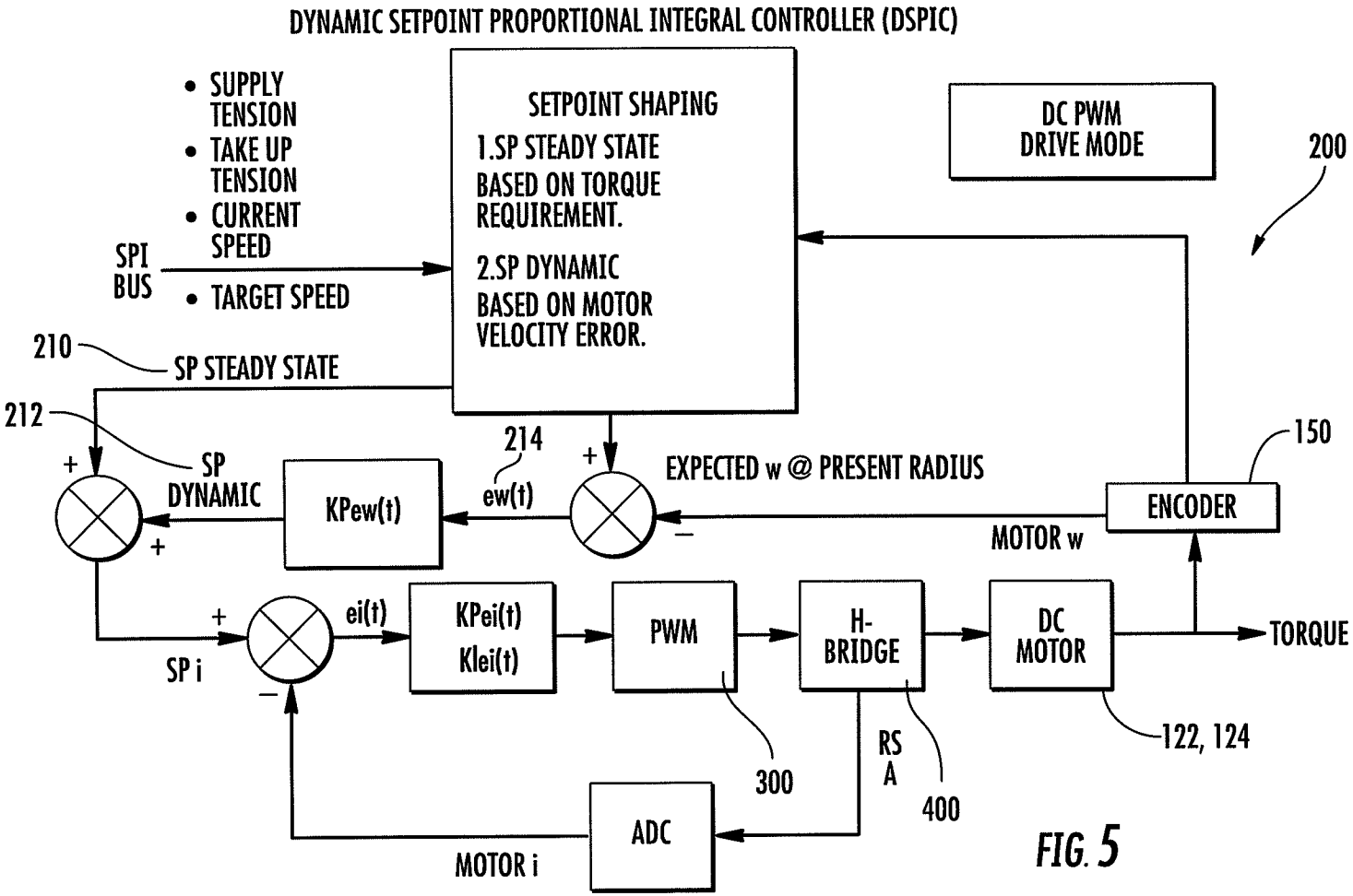
FIG. 5 is a schematic diagram of one preferred arrangement of the control system.

FIG. 5 shows the schematic diagram topology of an exemplary control system 200. This topology applies to the take up motor 124 when feeding forwards and the supply motor 122 when feeding backwards. In cases where the electrically commanded rotation of the motor is in an opposite direction to the physical rotation, another topology must be used. The drive system is designed to maintain a constant ribbon tension by continuously adjusting motor torque of each motor 122, 124 as the ribbon radius about each spindle 112, 114 increases or decreases. Since motor torque is proportional to motor current the drive system regulates motor current. The motor current Setpoint (SPi) is comprised of a steady state component 210 (SP Steady State) which is the torque required for desired ribbon tension and a dynamic component 212 (SP Dynamic) required for ramp up and to damp out system ringing due to the ribbon's elastic characteristics or properties.

It will be understood by those skilled in the art that the motor current set point is defined as:

$$SPi = \text{SP Steady State} + \text{SP Dynamic}$$

which is a desired motor current in milliamps. The steady state component 210 is based on the torque required at the given ribbon radius to produce a desired and predefined ribbon tension. The dynamic component 212 is based on the dynamic system behavior. The inner loop of the control system 200 regulates motor current. The outer loop compensates for dynamic characteristics of the system 200 using a concept known as dynamic set point shaping. The dominate dynamic characteristic of the system 200 is torque/ribbon tension ringing due to the ribbon stretching and contracting when subjected to force loads during acceleration. This system ringing is reflected through the gear train and is readily observable as velocity instability of the motor.

Velocity error 214 is determined by subtracting the present motor angular velocity from the steady state angular velocity expected for the given radius and feed speed. This is the outer negative feedback loop. The velocity error 214 $e\omega(t)$ is then multiplied by a proportion coefficient KP and is used to shape the motor current set point SPi. This results in a dynamically changing set point during acceleration and until the system damps out.

As the system 200 settles out the velocity error 214 goes to zero leaving the steady state set part remaining to achieve the necessary torque. Because the SPi has a dynamic component 212, the control system 200 automatically compensates for acceleration, ringing, ribbon radius, feed speed, and load disturbances. Advantageously, this new topology has eliminated velocity/torque/tension variations which caused blousing and hence print quality defects.

Figure 6:
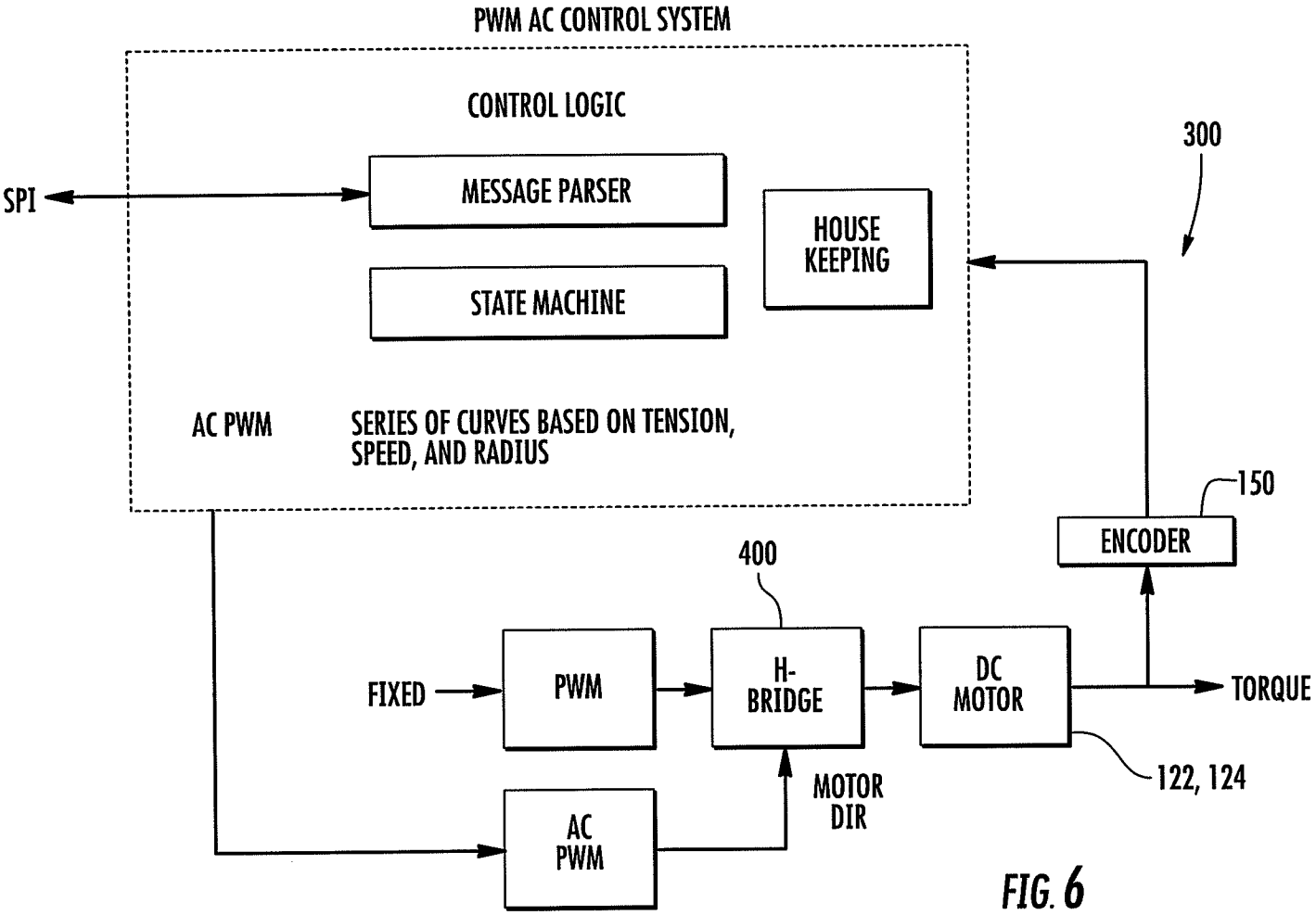
FIG. 6 is a schematic diagram of one preferred arrangement of the control system.

In cases where the electrical motor drive direction and physical rotation differ, another control method is needed. This method employs a Pulse Width Modulator (PWM) 300 to rapidly alternate the motor current direction at the motor drive H-Bridge 400. This results in driving the motor 122, 124 with an AC current waveform. The topology of such a control system 300 for this method is shown and set forth in FIG. 6.

Figure 7:
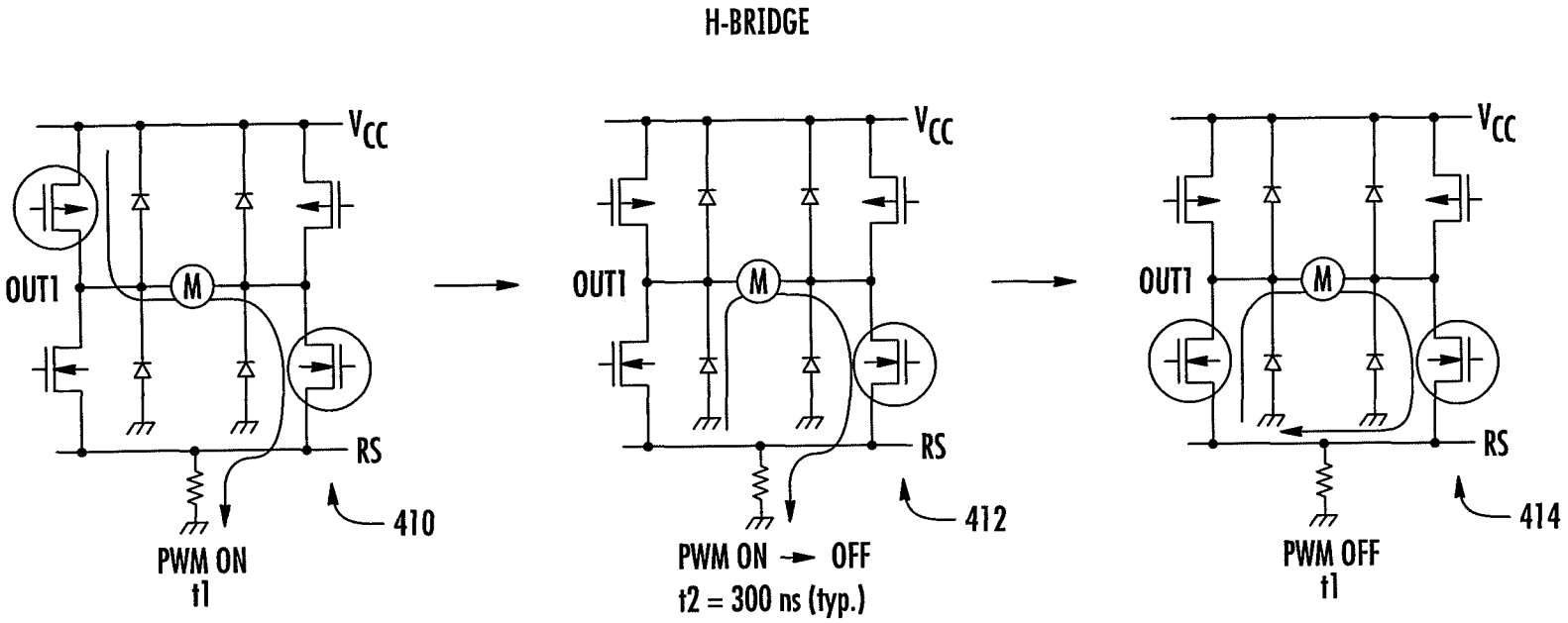
FIG. 7 is a schematic diagram of H-Bridge in the ON, OFF and BRAKING settings.

Referring now to FIG. 7, an H-Bridge 400 schematic is shown. As shown, in normal drive mode the Back EMF assists motor current decay during the PWM off cycle 410. When motor electrical drive direction and physical rotation differ in direction Back EMF becomes Forward EMF, as shown in 412. Forward EMF causes run-away current rise. AC Drive mode alternates current direction using a PWM to set the forward versus reverse motor current duty cycle. As shown in 414, during PWM OFF, Back EMF causes motor current decay, Forward EMF causes motor current rise.

The embodiments described above provide advantages over conventional devices and associated methods of manufacture. It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents. Furthermore, the foregoing description of the preferred embodiment of the invention and best mode for practicing the invention are provided for the purpose of illustration only and not for the purpose of limitation—the invention being defined by the claims.

What is claimed is:

1. A ribbon drive assembly housed within a printer for optimizing the tension of a ribbon supply, comprising:

a base plate;

first and second rotatable spindles configured to receive a ribbon supply, said rotatable spindles being rotatably connected to the base plate such that each spindle can rotate in either a clockwise or counter clockwise direction;

a first drive system connected to the base plate and coupled to the first spindle and being configured to rotate the first spindle, said first drive system having a plurality of gears for rotating the first spindle, a motor for driving the plurality of gears in either a clockwise or counter clockwise direction, and a rotary encoder; and control means coupled to the motor of the first drive system and being operative for independently controlling the drive direction of the first rotatable spindle so as to substantially maintain a constant ribbon tension on the ribbon supply.

2. The ribbon drive assembly of claim 1, further comprising:

a second drive system connected to the base plate and coupled to the second spindle and being configured to rotate the second spindle, said second drive system having a plurality of gears for rotating the second spindle, a motor for driving the plurality of gears in either a clockwise or counter clockwise direction, and a rotary encoder; and control means coupled to the motor of the second drive system and being operative for independently controlling the drive direction of the second rotatable spindle so as to substantially maintain a constant ribbon tension on the ribbon supply.

3. The ribbon drive assembly of claim 1, wherein distal ends of the first and second rotatable spindles extend through a port of a cover plate such that the distal ends are operative for receiving a roll of ribbon supply.

4. The ribbon drive assembly of claim 1, wherein the plurality of gears of the first drive system has a 23:1 gear reduction.

5. The ribbon drive assembly of claim 2, wherein the plurality of gears of the second drive system has a 23:1 gear reduction.

6. The ribbon drive assembly of claim 1, wherein the motor of the first drive system is a DC motor.

7. The ribbon drive assembly of claim 2, wherein the motor of the second drive system is a DC motor.

8. The ribbon drive assembly of claim 1, wherein the control means is a circuit board having a control processor.

9. The ribbon drive assembly of claim 2, wherein the control means is a circuit board having a control processor.

10. The ribbon drive assembly of claim 1, wherein the control means is in communication with a main processor of the printer.

11. The ribbon drive assembly of claim 2, wherein the control means is in communication with a main processor of the printer.

12. A thermal transfer printing device having a ribbon drive assembly for optimizing the tension of a ribbon supply, comprising:

a housing comprised of a base plate connected to a cover plate, said cover plate having a pair of ports disposed therethrough;

a supply spindle and a take up spindle rotatably connected to the base plate and extending through the pair of ports such that the spindles can receive a ribbon supply;

a first drive system connected to the base plate and coupled to the supply spindle, said first drive system having a plurality of gears for rotating the supply spindle, a motor for driving the plurality of gears in either a clockwise or counter clockwise direction, and a rotary encoder; and control means coupled to the motor of the first drive system for controlling the drive direction of the supply rotatable spindle.

13. The thermal transfer printing device of claim 12, further comprising a second drive system connected to the base plate and coupled to the take up spindle, said second drive system having a plurality of gears for rotating the take up spindle, a motor for driving the plurality of gears in either a clockwise or counter clockwise direction, and a rotary encoder; and control means coupled to the motor of the second drive system for controlling the drive direction of the take up rotatable spindle.

14. The thermal transfer printing device of claim 13, wherein the plurality of gears of the first and second drive systems each have a 23:1 gear reduction.

15. The thermal transfer printing device of claim 13, wherein the motors of the first and second drive systems are DC motors.

16. The thermal transfer printing device of claim 13, wherein the control means of the first and second drive systems are a circuit board having a control processor.

17. The thermal transfer printing device of claim 16, wherein the control means of the first and second drive systems are in communication with a main processor of the printing device.

18. A system for maintaining a constant ribbon tension within a ribbon drive assembly of a thermal transfer printer, comprising:

a base plate connected to a cover plate having a pair of ports disposed therethrough;

first and second rotatable spindles rotatably connected to the base plate and extending through the pair of ports such that the spindles can receive a ribbon supply;

first and second drive systems connected to the base plate and coupled to each of the respective first and second spindles, said first and second drive systems having a plurality of gears for rotating the respective first and second spindles, a motor for driving the plurality of gears in either a clockwise or counter clockwise direction, and a rotary encoder;

first and second control means coupled to the motors of the first and second drive systems for controlling the drive direction of the first and second rotatable spindles; and a print station adapted for receiving an unused portion of ribbon supply from the first spindle, printing a desired form on a media using the unused ribbon supply, and feeding the used portion of ribbon supply to the second spindle.

19. The system of claim 18, wherein torque on the motors are continuously adjusted to maintain a constant ribbon tension on the ribbon supply throughout operation of the print station.

20. The system of claim 18, wherein the drive systems of the first and second spindles calculate the radius of the ribbon supply disposed upon each of the first and second spindles to determine the required torque level of each motor.

* * * * *